United States Patent [19]

Gailey et al.

[11] Patent Number: 4,850,172

[45] Date of Patent: Jul. 25, 1989

[54] CEILING OR LIKE STRUCTURAL SYSTEM AND SPLICE MEMBER THEREFOR

[75] Inventors: J. Lynn Gailey, Newton Falls; Thomas O. Johnstone, Cortland; Frank Malachowski, Columbia Station, all of Ohio

[73] Assignee: Alcan Aluminum Corporation, Cleveland, Ohio

[21] Appl. No.: 105,963

[22] Filed: Oct. 2, 1987

Related U.S. Application Data

[63] Continuation of Ser. No. 856,635, Apr. 25, 1986, abandoned.

[51] Int. Cl.[4] ..... F16B 7/04

[52] U.S. Cl. ..... 52/665; 52/726; 403/300

[58] Field of Search ..... 52/664, 665, 666, DIG. 5, 52/667, 726; 403/300, 205

[56] References Cited

U.S. PATENT DOCUMENTS

| | | | |
|---|---|---|---|
| 2,689,630 | 9/1954 | Drury | 52/664 |
| 2,946,414 | 7/1960 | Gordon | 52/726 |
| 3,119,475 | 1/1964 | Adams | 52/DIG. 5 |
| 3,284,977 | 11/1966 | Lickliter | 52/726 |
| 3,390,503 | 7/1968 | Emerick | 52/667 |
| 3,590,546 | 7/1971 | Lambert | 52/664 |
| 4,335,973 | 6/1982 | Beck | 52/667 |

*Primary Examiner*—John E. Murtagh
*Attorney, Agent, or Firm*—Cooper & Dunham

[57] ABSTRACT

A ceiling system constituted of inverted T support members arranged in a horizontal grid, wherein T members aligned in end-to-end relation are interconnected by a splice member bridging the joint between them and having a pair of horizontally spaced clips respectively projecting through openings in end portions of the webs of the interconnected T members. The splice member is a sheet element having portions bent laterally and downwardly about horizontal bending axes to form the clips, and side edges bent obliquely about vertical bending axes for bearing against the webs of the T members to cooperate with the clips in securely interlocking the splice member and the T members.

13 Claims, 3 Drawing Sheets

8
8

CEILING OR LIKE STRUCTURAL SYSTEM AND SPLICE MEMBER THEREFOR

This is a continuation of application Ser. No. 856,635, filed April 25, 1986, now abandoned.

BACKGROUND OF THE INVENTION

This invention relates to structural systems including interconnected, endwise-aligned elongated members, and to splice members therefor. In a particular sense, the invention is directed to ceiling systems of the type having a grid of horizontally elongated, interconnected support members, some of which are aligned end to end, and to splice members for interconnecting adjacent support members thus aligned.

In present-day building construction, a suspended ceiling of panels or tiles is frequently provided below the structural ceiling of a room, for acoustic or aesthetic reasons or to conceal equipment located in the space between the suspended and structural ceilings. A known type of suspended ceiling includes an assembly of horizontally elongated support members of inverted T cross-section, interconnected to form a rectangular grid and each having a vertical web with opposed longitudinal flanges projecting from the base of the web to support the ceiling tiles. The grid comprises a first plurality of the T members, referred to as runners, disposed in spaced parallel relation to each other and suspended by wires or other means from the building structure, and a second plurality of T members extending in spaced parallel relation to each other transversely between the runners. Each runner may be constituted of two or more individual T members aligned end to end and interconnected by splice members that bridge the joints between them and have horizontally spaced lugs or tabs projecting through openings in the end portions of the T member webs, as shown, for example, in U.S. Pat. Nos. 2,873,828, 2,946,414, and 4,335,973. The transverse T members of the grid may also be aligned end to end on opposite sides of a runner, to or through which they may be interconnected endwise by hooks formed in or connected to the end portions of their webs for projecting through or engaging openings or seats in the runner webs, again as shown for example in the aforementioned U.S. Pat. Nos. 2,873,828, 2,946,414, and in U.S. Pat. Nos. 3,093,221, 3,096,862, and 3,187,856.

Splice members heretofore used or proposed for endwise interconnection of runner members have generally been more or less difficult to produce and/or complex to install. Additionally, they afford only relatively weak resistance to forces tending to pull the spliced runner members apart longitudinally. Transverse T member connecting means of known types are also vulnerable to disengagement when subjected to forces acting longitudinally of the connected T members. Such forces, as may be exerted on ceiling grids during earthquakes, can cause the T members of conventional grids to separate from each other, with resultant destructive damage to the ceilings and serious hazard of injury to persons or objects beneath. Accordingly, in some earthquake-prone regions, governmental regulations specify minimum requirements of strength (i.e., resistance to longitudinally directed separating forces), for connections between members of a ceiling grid, that have necessitated resort to special and costly expedients detracting from desired ease, convenience and economy of suspended ceiling construction.

SUMMARY OF THE INVENTION

The present invention, in a first aspect, broadly contemplates the provision of improvements in a structural system such as a ceiling system or the like of the type comprising at least two horizontally elongated members disposed in aligned end-to-end relation, and a splice member interconnecting the two elongated members. As in ceiling systems already known, each of the two elongated members has a planar vertical web with two opposed vertical may or surfaces, two opposed generally vertical ends, and a horizontally extending base, one end of the web of one of the two elongated members facing one end of the web of the other so as to define a joint therebetween, and openings being respectively formed in the webs of the two elongated members adjacent their last-mentioned ends; and the splice member, bridging the joint, has a horizontal lower margin and a vertical major surface facing an end portion of one major surface of the web of each of the two elongated members, the splice member also having two horizontally spaced clips respectively projecting through the openings formed in the webs of the two elongated members and respectively engaging the other major surfaces of these webs. It will be understood that the terms "horizontal" and "vertical" are used herein merely to express the relative orientation of structural features and elements of the system.

In accordance with the invention, each of the aforementioned openings has a lower edge spaced above the base of the elongated member web in which it is formed; the splice member is a rigid, substantially unitary sheet element; and each of the clips is a portion of the sheet element bent laterally and then downwardly about horizontal bending axes to form an inverted L projection with a depending leg spaced horizontally from and parallel to the vertical major surface of the splice member and having a free lower edge. Additionally, as particular features of the invention, the clips are dimensioned and positioned to be simultaneously freely insertable (i.e., insertable without being deflected relative to the body of the splice member, or otherwise deformed) through the web openings of the two elongated members when the lower margin of the splice member is at a predetermined elevation above the bases of the two elongated member webs and, after insertion through the openings, to respectively engage the aforementioned other surfaces of the elongated member webs upon downward movement of the splice member, with the depending legs extending downwardly to locations spaced substantially below the lower edges of the web openings, thereby to interlock the splice member and the two elongated members.

Conveniently or preferably, each of the web openings of the elongated members is of horizontally elongated rectangular configuration, the two openings being identical to each other in dimensions; and the two clips, as viewed in side elevation, are also of horizontally elongated rectangular shape and are identical to each other in dimension.

As a further particular feature of the invention, the splice member has opposed side edge portions bent obliquely about vertical bending axes for bearing respectively against the webs of the two elongated members to cooperate with the clips in securely interlocking the splice member and the two elongated members. For effective interlocking in this manner, the splice member (though substantially rigid) has some degree of resilient flexibility, being conveniently a formed sheet member of a metal such as aluminum, the term "aluminum" being used herein to refer to aluminum metal and aluminum-based alloys.

In a ceiling system embodying the invention, and comprising a plurality of horizontally elongated members serving as support members and interconnected to form a horizontally extending grid, the support members which are interconnected endwise by the splice member may cooperatively constitute a runner; that is to say, in a system wherein the runners comprise plural individual support members (e.g. inverted T members) joined end to end, the splice members may be employed to interconnect the constituent support members of each runner. Alternatively or additionally, especially for installations in areas subject to seismic disturbances, the splice members of the system of the invention may be employed to provide a secondary interconnection between transverse support members (also, e.g., inverted T members) which are aligned endwise on opposite sides of a runner and connected to the runner by primary connecting means.

Thus, in particular embodiments of the invention, the plurality of grid-forming support members includes at least one runner member, and two support members interconnected by a splice member as defined above extend perpendicularly to the runner member and are respectively disposed on opposite sides thereof; the runner member has a vertical web defining an aperture with two vertically spaced seat portions formed along one side of the aperture; the facing ends of the webs of the two last-mentioned support members are respectively formed with hooks for respectively engaging the seats to interconnect these two support members with the runner member, the joint between the two support members being located at the aperture; and the aperture is dimensioned to permit insertion of the splice member longitudinally therethrough after the hooks have engaged the seats and before the splice member clips are inserted through the clip-receiving openings respectively formed in the end portions of the webs of the two last-mentioned support members, the splice member (when installed) extending through the runner web aperture, and the clips, respectively inserted through the last-mentioned openings, being respectively disposed on opposite sides of the runner web. For use in such embodiments, the splice member may have an offset central portion, intermediate the clips, to accommodate the aforementioned runner web aperture seat portions. Where the runner aperture has a lower edge elevated above the lower margin of the splice member, the central portion of the splice member is formed with a notch in its lower margin to accommodate the runner member web below the lower edge of the aperture.

In a second aspect, the invention contemplates the provision of a splice member as defined above, e.g. for use in a ceiling system of the above-described type to interconnect adjacent endwise-aligned support members of the system. The splice member has the aforementioned clips and obliquely bent edge portions preformed therein.

The ceiling system and splice member of the invention afford important advantages with respect to simplicity and strength of interconnection of endwise aligned support members in a ceiling grid. The splice member is fabricated easily and inexpensively by cutting and bending an initially flat sheet metal blank. Since the clips and edge bends are preformed, and since the clips are dimensioned and positioned to be freely insertable through the support member web openings (so that there is no need to provide for deflection or deformation of the clips during installation), the splice member is desirably structurally strong as well as easy to install. The engagement of the clip legs with the support member webs at localities spaced substantially below the lower edges of the web openings, especially in conjunction with the action of the bent edge portions of the splice member bearing against the support member webs, securely interlocks the splice member with the endwise-aligned support members it interconnects; and the horizontal orientation of the bending axes of the clips, parallel to the long dimensions of the interconnected support members, prevents the clips from being bent (so as to release the support members) by forces directed longitudinally of the support members. Both in the case of support members spliced endwise to constitute a runner, and in the case of transverse support members interconnected endwise through a runner by the splice member, the resistance of the interconnections to separation under longitudinal forces resulting from seismic disturbances substantially exceeds the minimum requirements specified by governmental regulations and ensures maintained safety and structural integrity of the ceiling under earthquake conditions. As another advantage, the splice members employed to interconnect endwise-aligned runner members may be identical to those used to interconnect endwise-aligned transverse support members in the grid.

Further features and advantages of the invention will be apparent from the detailed description hereinbelow set forth, together with the accompanying drawings.

DETAILED DESCRIPTION

Figures 1, 2:
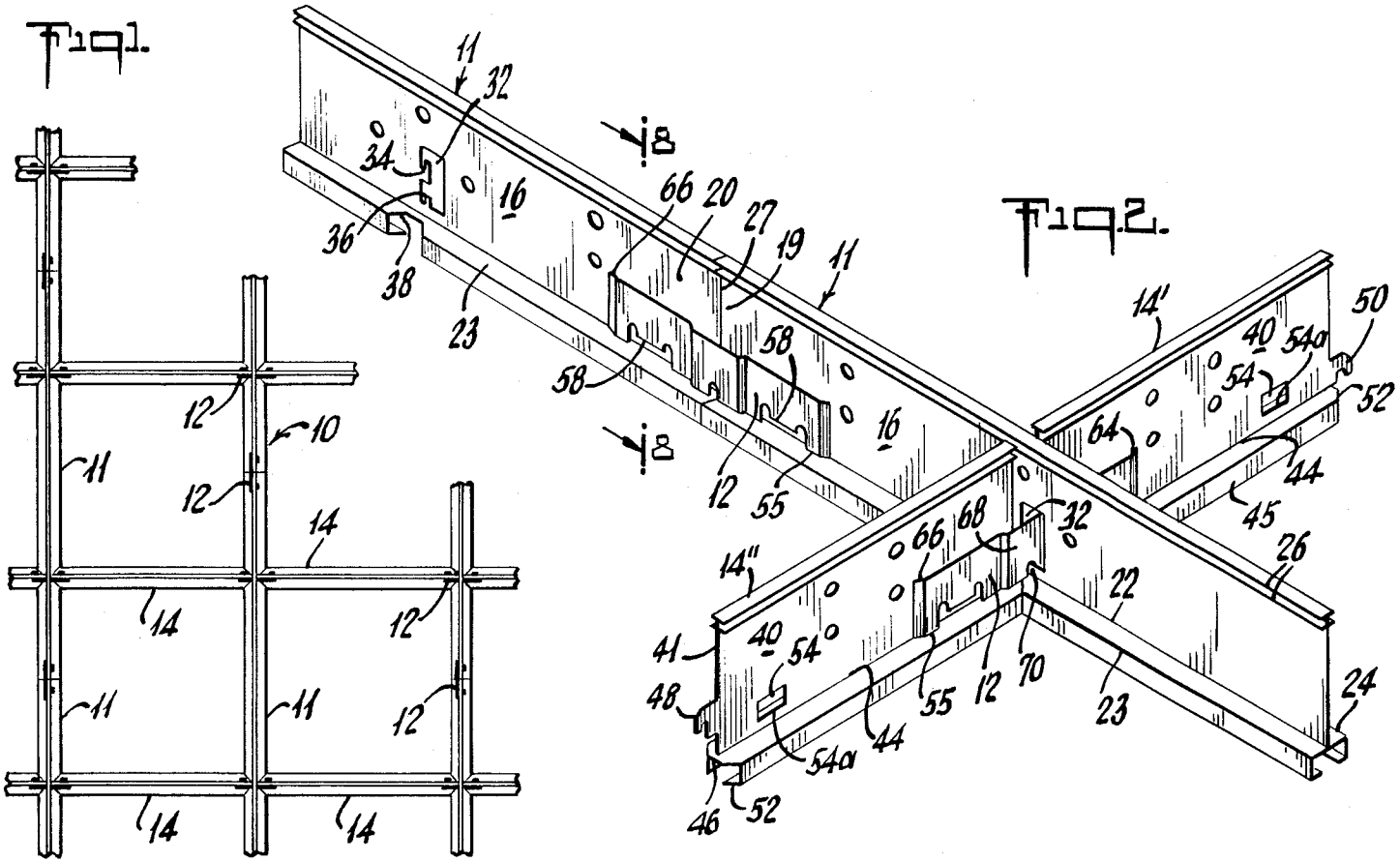
FIG. 1 is a somewhat simplified and schematic fragmentary top plan view of a grid-type ceiling system (with the ceiling tiles omitted) embodying the present invention in a particular form.
FIG. 2 is an enlarged isometric view, from above, of a portion of the ceiling system of FIG. 1.

The invention will be described, with reference to the drawings, as embodied in a ceiling system including two sets of horizontally elongated support members interconnected to form a horizontally extending rectangular grid 10 adapted to be suspended (by suitable means, not shown) beneath a structural ceiling in a room and to support a multiplicity of ceiling tiles (also not shown) cooperatively constituting a suspended ceiling. The support members 11 of the first set are arranged in a plurality of runners extending in uniformly spaced parallel relation to each other lengthwise of the grid; each of the runners includes two or more of the members 11 aligned end to end and interconnected by splice members 12. The support members 14 of the second set extend transversely of the grid (and again in uniformly spaced parallel relation to each other) between and perpendicularly to the runners, to which the members 14 are secured at their ends with each member 14 extending between two adjacent runners and meeting each of the adjacent runners at a locality intermediate the ends of one of the members 11 constituting that runner. Pairs of the members 14 respectively disposed on opposite sides of a runner are aligned end to end with each other and are secondarily interconnected to each other, through the runner, by means of additional splice members 12.

As best seen in FIGS. 2, 3, 8A and 8B, each of the support members 11 (hereinafter referred to as "runner members") is a rigid, unitary, horizontally elongated element of inverted T cross section having a planar vertical web 16 with two opposed vertical major surfaces 17, 18, two opposed vertical ends 19, 20, and a horizontally extending base 22 from which opposed longitudinal flanges 23, 24 project to provide ledges for supporting marginal portions of ceiling tiles. The flanges 23, 24 may be box flanges (as shown) or of any other suitable shape. The upper edge of the web 16 is formed with one or more longitudinal ridges 26 with which the aforementioned means for suspending the grid may be engaged. When two runner members are assembled in aligned end-to-end relation to constitute a runner, their vertical facing web end edges abut each other at a linear joint 27, and their webs are coplanar.

Figure 3:
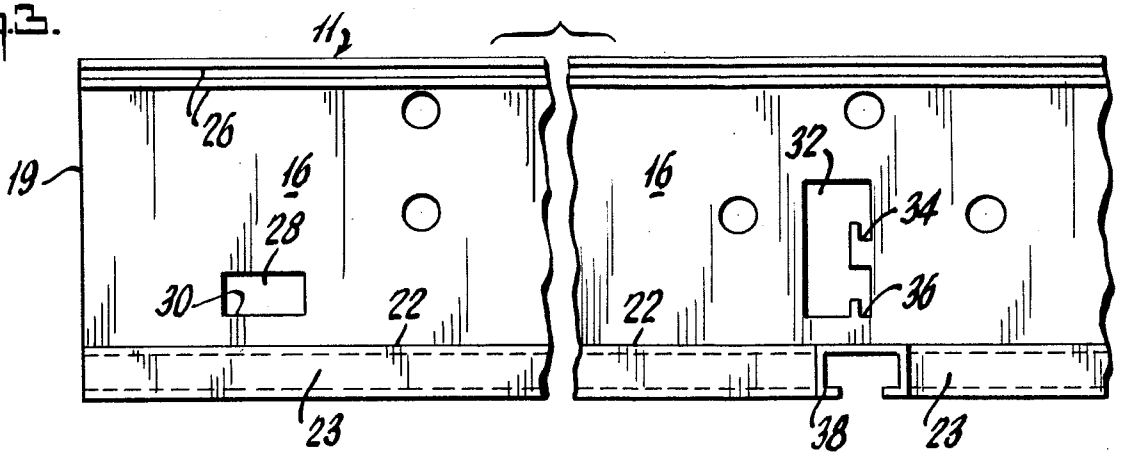
FIG. 3 is a further enlarged fragmentary side elevational view of one of the support members constituting a runner in the system of FIG. 1.

Adjacent, but spaced horizontally from, the one web end 19 shown in FIG. 3, a horizontally elongated rectangular opening 28 is formed in the web 16, having a lower edge 30 spaced above the base 22 of the web (and thus above the flanges 23, 24); an identical opening is formed in the web adjacent its other end (not shown in FIG. 3) and identically positioned relative to such other end of the web and to the web base. In the portion of the web 16 intermediate these two openings, also shown fragmentarily in FIG. 3, the web defines at least one aperture 32 of generally rectangular, vertically elongated configuration having a lower edge spaced above the web, with two vertically spaced seat portions 34 and 36 being formed along one side of the aperture. Preferably, a plurality of such apertures are provided at locations spaced horizontally along the web, to enable connection of members 14 to the runner member 11 (in the manner hereinafter described) at any one or more of such locations. A bevelled notch 38 is cut in each longitudinal flange 23 and 24 of the member 11 beneath each aperture 32.

Each member 11 may conveniently be an extruded aluminum section, in which the aforementioned ends, openings, aperture or apertures and associated seat portions and notches are formed by cutting and punching operations after extrusion.

Figure 4:
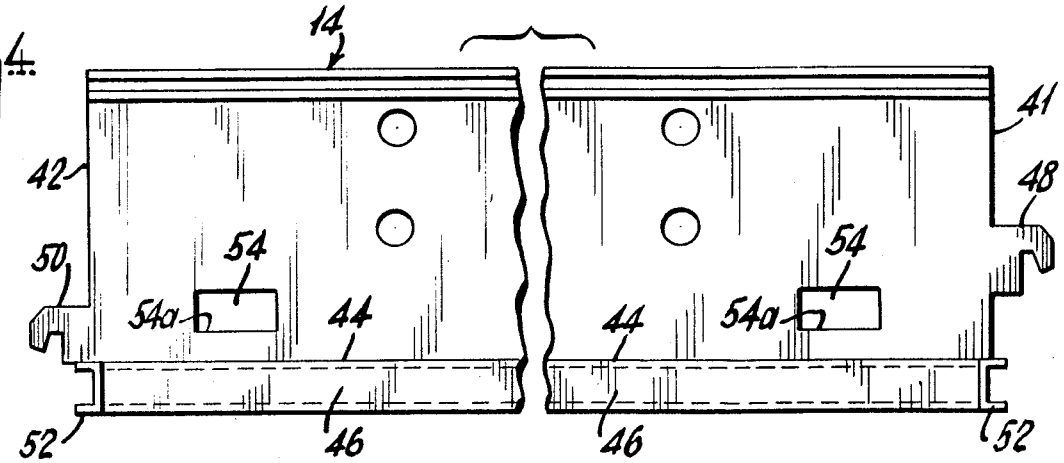
FIG. 4 is a fragmentary side elevational view, to the same scale as FIG. 3, of one of the transverse support members of the system of FIG. 1.
Figure 5:
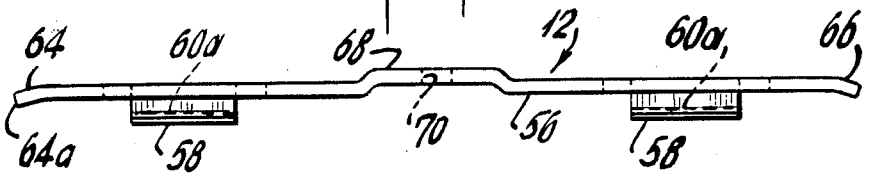
FIG. 5 is, a top plan view, to the same scale, of one of the splice members of the system of FIG. 1.

As best seen in FIGS. 2 and 4, each of the support members 14 (hereinafter referred to as "transverse members") is a rigid, unitary, horizontally elongated element of inverted T cross section identical in configuration and dimensions to the cross section of the members 11, and thus including a planar vertical web 40 with opposed vertical major surfaces, two opposed generally vertical ends 41 and 42, and a horizontally extending base 44 from which extend opposed longitudinal flanges 45, 46, again adapted to support marginal portions of ceiling tiles. The members 11 and 14 may accordingly be produced from identical aluminum extruded sections. The members 14, however, are typically substantially shorter than the members 11, and also differ therefrom in that the web ends 41 and 42 of each member 14 are cut to form hooks 48 and 50 projecting horizontally in the plane of the web at respectively different elevations for respectively engaging the vertically spaced seat portions 34 and 36 at apertures 32 in the webs of runner members 11. Additionally, the ends of the flanges 45 and 46 of the transverse members 14 are bevelled, as indicated at 52, so as to fit into the notches 38 formed in the runner member flanges.

In the assembled grid, the hook 48 at end 41 of one transverse member (designated 14' in FIG. 2) disposed on one side of a runner member 11 is engaged with the upper seat portion 34 at the aperture 32 in the runner member web, and the hook 50 at end 42 of a second transverse member (designated 14"in FIG. 2) disposed on the other side of the runner member is engaged with the lower seat portion 36 of the same aperture 32, the two transverse members 14' and 14" being thus aligned end to end (with their webs coplanar) on opposite sides of the runner member and interconnected therewith. Their facing bevelled flange ends 52 are respectively received in the runner member flange notches 38 beneath the aperture 32, and the upper portions of their facing end edges are spaced apart sufficiently to accommodate the ridge 26 of the intervening runner member. At their other ends, the transverse members 14' and 14" are similarly connected (respectively by their hooks 50 and 48) to other runner members (not shown in FIG. 2). The hooks 48 and 50 and the seat portions 34 and 36 thus cooperatively constitute the primary means for interconnecting the transverse members 14 in the grid 10, and (in conjunction with the interfitting bevelled flange ends 52 and notches 38) secure the transverse members stably in the grid, in the absence of substantial disconnecting forces acting generally longitudinally of the transverse members.

Adjacent, but spaced horizontally from, the ends 41 and 42 of the web of each transverse member 14, two horizontally elongated rectangular openings 54 are formed in the transverse member web. These openings are identical in shape and dimensions to the openings 28 in the runner member webs 16, and have lower edges **54*a* spaced above the base 44 of the transverse member web 40 by a distance equal to the spacing of the lower edges of the openings 28 above the base 22 of the runner member web 16. The openings 54 are so positioned, relative to the respectively adjacent ends of the web 40, that when two transverse members (such as 14' and 14") are interconnected to a runner member in aligned end-to-end relation to each other, with the joint between them located at an aperture 32 of the runner member, the horizontal spacing between their respective adjacent openings 54 across the latter joint is equal to the horizontal spacing between the respective adjacent openings 28 across a joint 27 between endwise-aligned members 11 in a runner. As in the case of the members 11, the openings 54, ends 41 and 42 including hooks 48 and 50, and bevelled flange ends 52, may be formed by cutting and punching operations after extrusion of sections from which the members 14** are produced.

The remaining components of the grid 10, in the described embodiment of the invention, are the splice members 12, all of which are conveniently identical to each other. As best seen in FIGS. 2 and 5–8B, each splice member 12 is a substantially rigid, unitary sheet element of horizontally elongated, generally rectangular configuration as viewed in side elevation (FIG. 6), with a horizontal lower margin 55, a vertical (but multiplanar) major surface 56 and two identical horizontally spaced clips 58 both projecting in the same direction (and at the same elevation) from the surface 56. As hereinafter further explained, in the assembled grid the two clips of a splice member respectively project through the respective openings 28 of two endwise-aligned runner members 11 adjacent a joint 27 to interconnect these two runner members, or, alternatively, the two clips project through the respective openings 54 of two endwise-aligned transverse members (e.g. 14' and 14", FIG. 2) adjacent a joint therebetween, to provide a secondary interconnection between the latter transverse members; in each case, the splice member bridges the joint between the two endwise aligned support members it interconnects, and the splice member major surface 56 faces an end portion of one major surface of the web of each of those two support members.

Figure 6:
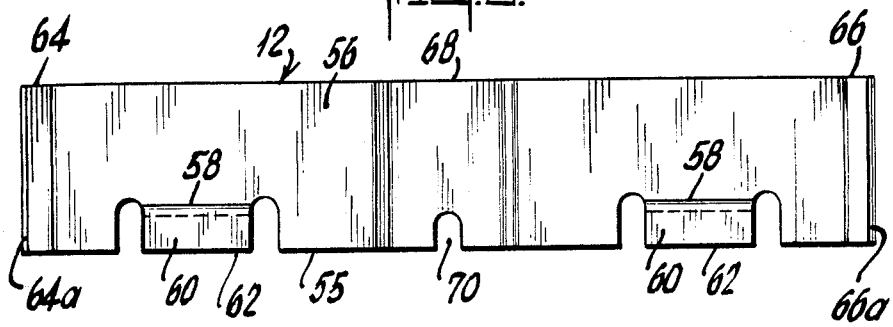
FIG. 6 is a side elevational view of the splice member, to the same scale.
Figure 7:
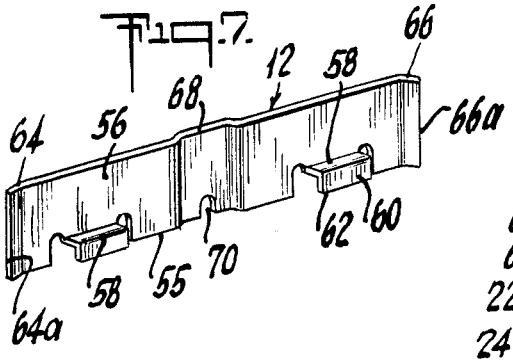
FIG. 7 is an isometric view, at a reduced scale, of the splice member.
Figure 8A:
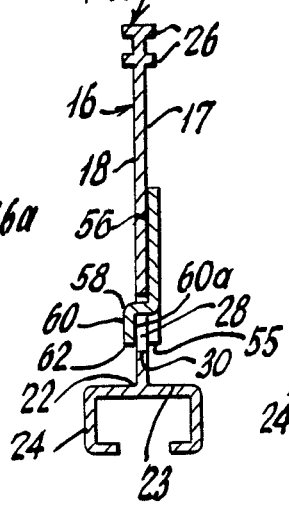
FIGS. 8A and 8B are sectional elevational views, to the same scale as FIGS. 3–6 and taken as along the line 8—8 of FIG. 2, showing successive steps in the installation of a splice member.
Figure 8B:
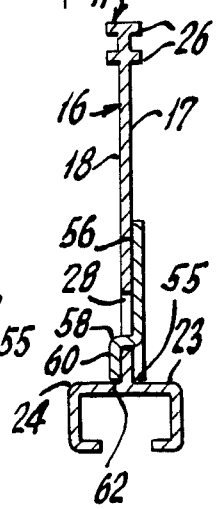

Each of the clips 58 is a portion of the aforementioned sheet element bent laterally and then downwardly about horizontal bending axes to form an inverted L projection with a depending leg 60 spaced horizontally from and parallel to the vertical splice member surface 56 and having a free lower edge 62. The clips are of horizontally elongated rectangular shape as viewed in side elevation (FIG. 6). They are dimensioned and positioned to be simultaneously freely insertable through two openings 28 or two openings 54 when the lower margin 55 of the splice member is at a predetermined elevation above the bases of the webs 16 or 40 of two endwise-aligned support members 11 or 14 (i.e. with the splice member surface 56 facing one major surface of the web of each of the aligned support members), as shown in FIG. 8A; and, after insertion through those openings, to respectively engage the other major surfaces of the last-mentioned webs upon downward movement of the splice member relative to the aligned support members, with the depending clip legs 60 extending downwardly to locations spaced below the lower edges 30 or **54*a* of the openings 28 or 54, as shown in FIG. 8B**.

Opposed side edge portions 64 and 66 of each splice member 12 are bent obliquely about vertical bending axes, in the same lateral direction in which the clips 58 project, for bearing respectively against the webs of the two aligned support members joined by the splice member, to cooperate with the clips in interlocking the splice member and the support members. Specifically, the vertical web-engaging extremities **64*a* and 66*a* of the bent edge portions in unstressed condition, lie in a vertical plane which is parallel to the plane of the web-engaging surface 60*a* of clip leg 60 and spaced therefrom by a distance less than the thickness of a support member web, so that the edge portions 64 and 66** must be slightly deflected from their unstressed positions when they and the clip legs respectively bear against opposite major surfaces of the support member webs. The splice member, though substantially rigid as stated, is sufficiently resilient to enable this deflection to occur.

Additionally, the splice member has an offset central portion 68, intermediate the clips, for accommodating the seat portions 34 and 36 (when the splice member is used to interconnect two transverse members 14 through an aperture 32), and the portion 68 is formed with a notch 70 in its lower margin to accommodate the runner member web below the lower edge of an aperture 32. The apertures 32, in the runner member webs 16, are dimensioned to permit longitudinal insertion of a splice member 12 therethrough after the hooks of two aligned transverse members 14 have engaged the seat portions 34 and 36 at the side of the aperture and before the clips 58 of the splice member have been inserted through the openings 54 of the latter transverse members.

Each splice member 12 is conveniently produced from an initially flat sheet aluminum blank by cutting and bending to preform the clips, side edge bends, and offset central portion and notch. That is to say, the splice member is fully preformed, having a sheet gauge and alloy composition and temper selected to provide the desired characteristics of strength, substantial rigidity and slight resilience.

The assembly of the described grid system 10, including the installation of the splice members 12, may now be readily explained. To assemble a runner, two of the runner members 11 are disposed in aligned end-to-end relation with their webs coplanar and their facing end edges abutting at a joint 27. A splice member is positioned to bridge the joint 27, with its major surface 56 facing one major surface 17 of the web 16 of each of the two aligned members 11 and its lower margin 55 elevated above the base 22 of each of the latter webs so that the two clips 58 are respectively in register with the two openings 28 on opposite sides of the joint. The splice member is advanced laterally (horizontally) toward the two members 11 until the clips are fully inserted through the openings (FIG. 8A), and is then forced downwardly as far as possible, i.e. to the position shown in FIG. 8B at which the free lower ends of the clip legs 60 are spaced substantially below the lower edges of the openings 28 and the leg surfaces **60*a* bear against the runner member web surfaces 18 while the edge portions 64 and 66 of the splice member, now slightly deflected, bear against the web surfaces 17, securely locking the runner members at the joint. Preferably, the dimensions of the splice member are such that, in the fully installed position, the lower margin 55 of the splice member substantially abuts the runner member flanges 23**. This procedure is repeated until all the runners of the grid have been assembled.

Next, the transverse members 14 are assembled with the runner by arranging them as described above and engaging the transverse member end hooks 48 and 50 with the seat portions 34 and 36 of the runner members. At this point, the grid 10 is complete, and has adequate structural stability for use in areas not subject to substantial seismic disturbances. If, however, there is a danger of strong earthquakes at the locality of installation, and/or if applicable governmental regulations require greater strength of interconnection than is provided by the primary (hook and seat portion) connections of the transverse members to the runner members, adjacent endwise-aligned transverse members may be secondarily interconnected by additional splice members 12 as shown in FIGS. 1 and 2. Each such splice member is inserted longitudinally through an aperture 32 of a runner member 11, after two endwise-aligned transverse members 14 have been secured by their hooks to the seat portions of the aperture, and is secured to the two latter transverse members (with the splice member clips respectively disposed on opposite sides of the runner member) by the same installation procedure as described above with reference to the interconnection of runner members, the aperture 32 being dimensioned to accommodate the horizontal and vertical movements of the splice member necessary to effectuate such installation. Although in other respects the assembly of the ceiling grid requires substantial care and skill, installation of splice members to interlock the transverse members can readily be performed by unskilled labor.

The assembled grid is suspended from a structural ceiling, e.g. by conventional means secured to the ridges 26 of the runner members, and ceiling panels are mounted on the grid to complete the suspended ceiling assembly.

In a specific example of the above-described embodiment of the invention, the support members 11 and 14 are extruded aluminum sections each having a vertical dimension of 1.5 inches, each runner member 11 being 10 feet long and each transverse member 14 being 5 feet long, with a web thickness (for each) of 0.050 inch. Each opening 28 is 0.250 inch (vertical dimension) by 0.500 inch (horizontal dimension), spaced 0.865 inch from the adjacent end of the runner member web, and has a lower edge spaced 0.152 inch above the base of the web. Each splice member 12 is fabricated of 0.060 inch gauge sheet of AA3004 or AA3005 aluminum alloy in H14 temper, with a nominal horizontal length of 3.750 inches and a height (vertical dimension) of 0.750 inch. Each clip 54, viewed in side elevation, has a horizontal dimension of 0.470 inch and a vertical dimension of about 0.210 inch. The spacing between the plane of surfaces 60*a* of the clip legs and the proximate portions of the splice member major surface 56 is nominally 0.060 inch. The side edge portions 64*a* and 66*a* are bent at 10° to the plane of the latter major surface portions; the spacing between the vertical plane containing extremities 64*a* and 66*a* and the plane of the latter major surface portions is nominally 0.022 inch, and, therefore, the horizontal spacing between the vertical plane containing extremities 64*a* and 66*a* and the vertical plane of clip leg surfaces 60*a* is nominally 0.038 inch.

The transverse members of the described grid, when interconnected with the runners only by hooks 48 and 50 engaged in seat portions 34 and 36, separate from the runner members under forces of about 20 lbs. acting longitudinally of the transverse members, but when secondarily interconnected by the splice member 12, withstand longitudinally directed forces of up to about 300 lbs., far in excess of a typical governmental requirement (in an earthquake-prone region) that the interconnections withstand separating forces of 180 lbs. directed longitudinally of the connected support members or at angles up to 5° to the longitudinal axes of the members.

It is to be understood that the invention is not limited to the features and embodiments hereinabove specifically set forth, but may be carried out in other ways without departure from its spirit.

What is claimed is:

1. A structural system comprising at least two horizontally elongated members disposed in aligned end-to-end relation, and a splice member interconnecting said two elongated members, each of said two elongated members having a vertical web with two opposed vertical major surfaces, two opposed generally vertical ends, and a horizontally extending base, one end of the web of one of said two elongated members facing one end of the web of the other of said two elongated members so as to define a joint therebetween, said splice member bridging said joint and having a horizontal lower margin and a vertical major surface facing an end portion of one major surface of the web of each of said two elongated members, each of said two elongated members having an opening formed in its web adjacent said one end thereof, and said splice member having two horizontally spaced clips respectively projecting through the openings formed in the webs of said two elongated members, said clips respectively engaging the other major surfaces of the webs of said two elongated members, wherein:

each of said openings has a lower edge spaced above the base of the elongated member web in which it is formed;

said splice member is a substantially rigid, unitary sheet element;

each of said clips is a preformed portion of said sheet element bent laterally and then downwardly about horizontal bending axes to form an inverted L projection with a depending leg spaced horizontally from and parallel to said vertical major surface of said splice member and having a free lower edge; and said clips are dimensioned and positioned to be simultaneously freely insertable through said openings when the lower margin of the splice member is at a predetermined elevation above the bases of the webs of said two elongated members and, after insertion through said openings, to respectively engage said other major surfaces of the last-mentioned webs upon downward movement of the splice member, with the depending legs extending downwardly to locations spaced substantially below the lower edges of said openings, thereby to interlock the splice member and said two elongated members, the dimensions of said clips, as measured in a plane perpendicular to the direction in which the clips move as they are inserted through said openings, being smaller than the dimensions of said openings as measured in the same plane, such that the clips pass undeflected through the openings in the last-mentioned direction free of interference.

2. A structural system comprising at least two horizontally elongated members disposed in aligned end-to-end relation, and a splice member interconnecting said two elongated members, each of said two elongated members having a vertical web with two opposed vertical major surfaces, two opposed generally vertical ends, and a horizontally extending base, one end of the web of one of said two elongated members facing one end of the web of the other of said two elongated members so as to define a joint therebetween, said splice member bridging said joint and having a horizontal lower margin and a vertical major surface facing an end portion of one major surface of the web of each of said two elongated members, each of said two elongated members having an opening formed in its web adjacent said one end thereof, and said splice member having two horizontally spaced clips respectively projecting through the openings formed in the webs of said two elongated members, said clips respectively engaging the other major surfaces of the webs of said two elongated members, wherein:

each of said openings has a lower edge spaced above the base of the elongated member web in which it is formed;

said splice member is a substantially rigid, unitary sheet element;

each of said clips is a preformed portion of said sheet element bent laterally and then downwardly about horizontal bending axes to form an inverted L projection with a depending leg spaced horizontally from and parallel to said vertical major surface of said splice member and having a free lower edge;

said clips are dimensioned and positioned to be simultaneously freely insertable through said openings when the lower margin of the splice member is at a predetermined elevation above the bases of the webs of said two elongated members and, after insertion through said openings, to respectively engage said other major surfaces of the last-mentioned webs upon downward movement of the splice member, with the depending legs extending downwardly to locations spaced substantially below the lower edges of said openings, thereby to interlock the splice member and said two elongated members; and said splice member has opposed side edge portions bent obliquely about vertical bending axes for bearing respectively against the webs of said two elongated members to cooperate with said clips in securely interlocking the splice member and said two elongated members.

3. A structural system as defined in claim 2, wherein each of said openings is of horizontally elongated rectangular configuration, and each of said clips as viewed in side elevation is of horizontally elongated rectangular configuration conforming generally to, but smaller than, said openings.

4. A structural system as defined in claim 2, for use as a ceiling system, comprising a plurality of horizontally elongated support members interconnected to constitute a horizontally extending grid, wherein said two elongated members are two of said support members.

5. A ceiling system as defined in claim 4, wherein said plurality of support members includes runners extending horizontally in spaced parallel relation to each other, and transverse members extending horizontally between and perpendicular two said runners, and wherein one of said runners comprises at least said two elongated members, the facing ends of the webs of said two elongated members being vertical and in abutment with each other.

6. A ceiling system as defined in claim 4, wherein said plurality of support members includes at least one runner member, wherein said two elongated members extend perpendicular to said one runner member and are respectively disposed on opposite sides thereof, wherein said one runner member has a vertical web defining an aperture with two vertically spaced seat portions formed along one side of the aperture, wherein the facing ends of the webs of said two elongated members are respectively formed with hooks for respectively engaging said seat portions to interconnect said two elongated members with said one runner member, said joint being located at said aperture; and wherein said aperture is dimensioned to permit insertion of said splice member longitudinally therethrough after said hooks have engaged said seat portions and before said clips are inserted through said openings, said splice member extending through said aperture, and said clips, respectively inserted through said openings, being respectively disposed on opposite sides of said runner member web.

7. A ceiling system as defined in claim 6, wherein said splice member has an offset central portion, intermediate said clips, for accommodating said seat portions; wherein said aperture has a lower edge elevated above the lower margin of said splice member; and wherein said central portion is formed with a notch in its lower margin to accommodate the runner member web below the lower edge of the aperture.

8. A ceiling system as defined in claim 4, wherein said support members are inverted T members each having a vertical web with a horizontally extending base from which opposed longitudinal flanges project.

9. A ceiling system as defined in claim 2, wherein said splice member is a formed sheet aluminum member.

10. A splice member for interconnecting, in aligned end-to-end relation, two horizontally elongated members each having a planar vertical web with two opposed vertical major surfaces, two opposed generally vertical ends, and a horizontally extending base, one end of the web of one of said elongated members facing one end of the web of the other of said elongated members so as to define a joint therebetween, each of the elongated members having an opening formed in its web adjacent said one end thereof, and each of said openings having a lower edge spaced above the base of the elongated member web in which it is formed, said splice member comprising a substantially rigid unitary sheet element having a horizontal lower margin and a vertical major surface for facing end portions of one major surface of the web of each of said elongated members;

horizontally spaced portions of said sheet element being respectively preformed into two clips by bending laterally and then downwardly about horizontal bending axes such that each clip is a rigid inverted L projection with a depending leg spaced horizontally from and parallel to said vertical major surface of said element and having a free lower edge spaced substantially below said horizontal bending axes, both clips projecting in the same horizontal direction from said last-mentioned vertical major surface so as to be respectively receivable in the openings of the two elongated members when the splice member is disposed to bridge the joint, with the last-mentioned major surface overlying the one major surface of each elongated member web and the clips, respectively extending through the openings, respectively engaging the other major surfaces of the webs beneath the lower edges of the openings; and said element being further preformed with opposed side edge portions respectively bent obliquely about vertical bending axes for bearing respectively against the webs of the two elongated members to cooperate with the clips in securely interlocking the splice member and the two elongated members.

11. A splice member as defined in claim 10, wherein said sheet element is a formed sheet metal element.

12. A splice member as defined in claim 10, wherein each of said clips, as viewed in side elevation, is of horizontally elongated rectangular configuration.

13. A structural system comprising at least two horizontally elongated members disposed in aligned end-to-end relation, and a splice member interconnecting said two elongated members, each of said two elongated members having a vertical web with two opposed vertical major surfaces, two opposed generally vertical ends, and a horizontally extending base, one end of the web of one of said two elongated members facing one end of the web of the other of said two elongated members so as to define a joint therebetween, said splice member bridging said joint and having a horizontal lower margin and a vertical major surface facing an end portion of one major surface of the web of each of said two elongated members, each of said two elongated members having an opening formed in its web adjacent said one end thereof, and said splice member having two horizontally spaced clips respectively projecting through the openings formed in the webs of said two elongated members, said clips respectively engaging the other major surfaces of the webs of said two elongated members, wherein:

each of said openings has a lower edge spaced above the base of the elongated member web in which it is formed;

said splice member is a substantially rigid, unitary sheet element;

each of said clips is a preformed portion of said sheet element bent laterally and then downwardly about horizontal bending axes to form an inverted L projection with a depending leg spaced horizontally from and parallel to said vertical major surface of said splice member and having a free lower edge;

said clips are dimensioned and positioned to be simultaneously freely insertable through said openings when the lower margin of the splice member is at a predetermined elevation above the bases of the webs of said two elongated members and, after insertion through said openings, to respectively engage said other major surfaces of the last-mentioned webs upon downward movement of the splice member, with the depending legs extending downwardly to locations spaced substantially below the lower edges of said openings, thereby to interlock the splice member and said two elongated members; and means, spaced horizontally from said clips and acting between said vertical major surface of said splice member and the webs of said two elongated members, for urging said vertical major surface of said splice member away from said webs of said two elongated members thereby to cooperate with said clips in securely interlocking the splice member and said two elongated members.

* * * * *